US005139284A

United States Patent [19]

Rönning et al.

[11] Patent Number: 5,139,284

[45] Date of Patent: Aug. 18, 1992

[54] SKI POLE

[76] Inventors: Trond Rönning, Haaggaavn, 17, N-7320 Fannrem; Terje Skjetne, Brundalsgrenda 4, N-7047 Trondheim; John Sandstad, Odins v. 18C, N-7037 Trondheim, all of Norway

[21] Appl. No.: 631,622

[22] Filed: Dec. 12, 1990

[30] Foreign Application Priority Data

Apr. 12, 1988 [NO] Norway ..... 881565

[51] Int. Cl.[5] ..... A63C 11/22

[52] U.S. Cl. ..... 280/823

[58] Field of Search ..... 280/819, 821, 823, 824, 280/820; 403/305, 308; 135/66

[56] References Cited

U.S. PATENT DOCUMENTS

| | | | |
|---|---|---|---|
| 2,741,485 | 4/1956 | Storm et al. | 280/824 X |
| 3,525,532 | 8/1970 | Baldsiefen | 280/823 X |
| 4,288,102 | 9/1981 | Ramer | 280/823 |

FOREIGN PATENT DOCUMENTS

| | | | |
|---|---|---|---|
| 56212 | 3/1981 | European Pat. Off. . | |
| 287188 | 9/1915 | Fed. Rep. of Germany | 280/819 |
| 2364066 | 9/1975 | Fed. Rep. of Germany . | |
| 966364 | 10/1950 | France | 280/824 |
| 993134 | 10/1951 | France | 280/819 |
| 630919 | 12/1961 | Italy | 280/819 |
| 187458 | 2/1937 | Switzerland . | |
| 434986 | 10/1967 | Switzerland | 280/819 |
| 598842 | 5/1978 | Switzerland . | |

*Primary Examiner*—Andres Kashnikow
*Assistant Examiner*—Michael Mar
*Attorney, Agent, or Firm*—Antonelli, Terry, Stout & Kraus

[57] ABSTRACT

A ski stick or ski pole which includes a main part composed of a shaft and a thinner ferrule part, with a transition between the main shaft and the thinner ferrule part being threaded with an outer diameter which is substantially smaller than the shaft of the stick. A female thread is provided at the other end of the stick, with the female thread corresponding to the thread of the thinner part whereby two or more sticks may be connected together into long staves.

2 Claims, 1 Drawing Sheet

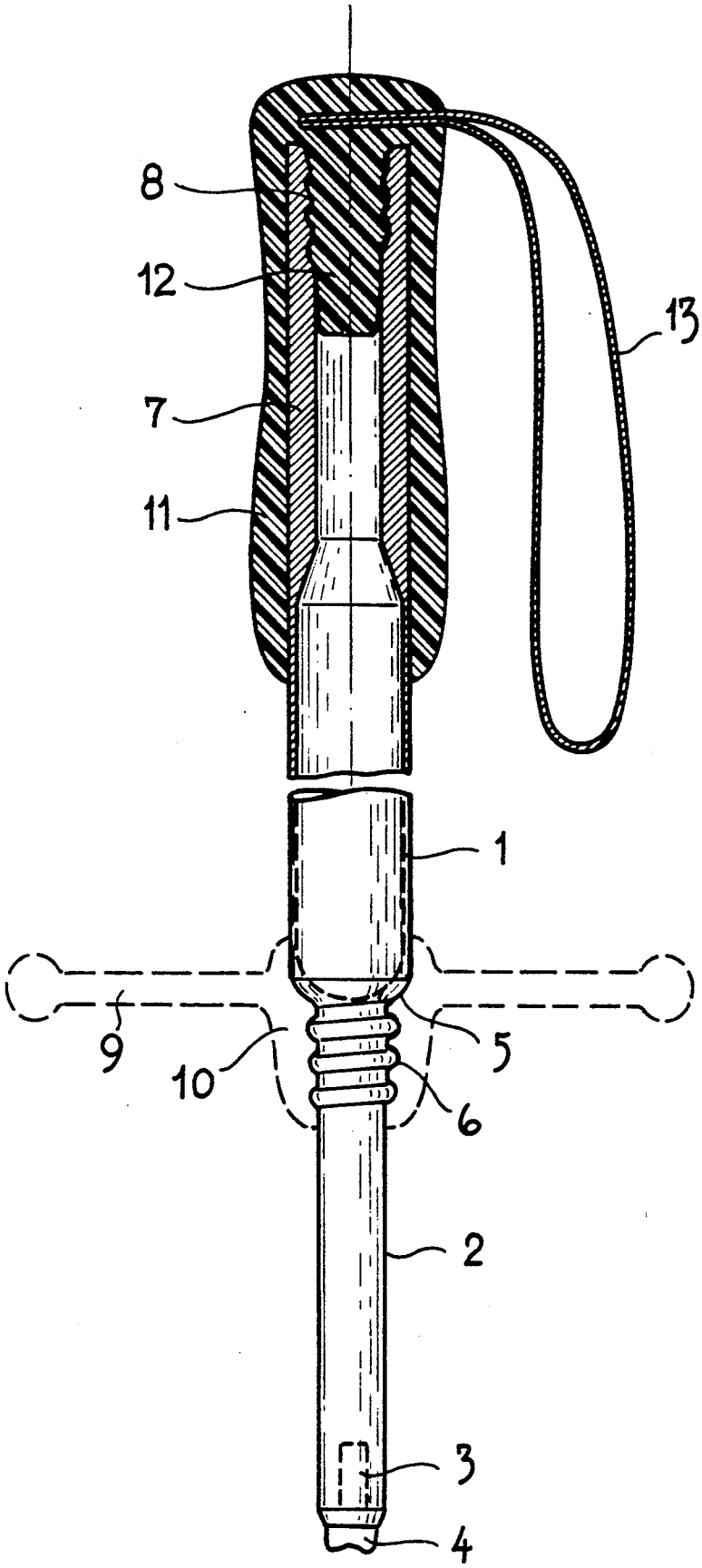
8
12
13
7
11
1
9
10
5
6
2
3
4

SKI POLE

CROSS-REFERENCE TO RELATED APPLICATION

This application is a continuation application under 35 USC 365(c) and 35 USC 120 of International Application No. PCT/No. 89/00027, filed Apr. 6, 1989, based on Norwegian Application 881,565 filed Apr. 12, 1988, as filed in the United States Patent and Trademark Office on Oct. 12, 1990, now abandoned.

FIELD OF THE INVENTION

The present invention relates to a ski stick or a ski pole including a main part fashioned as a shaft, with a lower end of the shaft having a thinner part of ferrule.

BACKGROUND OF THE INVENTION

In certain circumstances, ski sticks or ski poles are used for purposes other than skiing. For example, ski sticks or ski poles are provided useful in emergencies such as use as tent poles, stretchers, and sleds where skis are used as the runners. As such application or use of the ski sticks or ski poles are improvised, they are relatively unsuccessful since the ski sticks or ski poles in everyday use do not have the necessary adaptability.

DOS 2,364,066 proposes a telescopic retractable ski stick; however, the retractability of the ski sticks or ski pole does not extend an area of application or use of a ski sticks or ski pole.

European Application No. 56212, proposes a ski stick fitted with an ice spike; however, the provision of the spike does not extend the application area of the ski stick other than for skiing purposes.

Means for connecting poles are known so that when the poles are combined they become long enough for tasks such as the support of tents. However, connection means are either inadequate for extensive use or can result in a malfunction and wear if overused.

SUMMARY OF THE INVENTION

The aim underlying the present invention essentially resides in providing a stick construction, more particularly, a ski stick or pole construction adapted to be connected into staves.

It is an object of the present invention to design a ski stick which has a better connection mechanism than that known in other pole systems.

Another object of the present invention is to design a ski stick or pole which has a much wider range of application than known ski sticks or poles.

A further object of the present invention is to provide a ski sticks or ski pole which can also be used as a snow probe.

In accordance with the present invention, at a transition between the main shaft of the ski pole or stick and the lower thinner end part of the shaft, a threaded connection or force fitted connection is provided with a male portion of the thread corresponding to the female thread provided in the other end of the stick and the female thread extends into a receptacle surrounded by a ferrule on the stick or pole.

According to the present invention, a disc or part with a disc connected to it is threaded onto the male thread and constructed to protect the thread. The stick is fashioned as a shaft having an upper hollow section with a thickened wall portion.

Advantageously, the threadable connection portions are conically shaped.

By virtue of the features of the present invention, it is possible to connect poles, in particular, ski sticks or ski poles whereby two or more sticks can be connected into a snow probe or rescue stick in an emergency situation.

With a pole or stick constructed in accordance with the present invention, it is also possible to use the same as a walking stick or stave to hold while trekking, cross glaciers, or the like.

The above and other objects, features and advantages of the present invention will become more apparent from the following description when taken in connection with the accompanying drawing.

BRIEF DESCRIPTION OF THE DRAWING

The single FIGURE is a partial cross-sectional view of a ski stick or ski pole constructed in accordance with the present invention.

DETAILED DESCRIPTION

Referring now to the Single Figure, according to the present invention, the ski stick has a tubular main shaft 1, with a lower part 2 in the form of a ferrule. The lower part 2 is of a considerably smaller diameter than the main shaft 1. The lower part 2 includes a cavity or equivalent aperture at the lower end for accommodating the stem 3 of a stud 4. In an alternative design, the stud could be pressed and inserted into the lower part 2.

The upper end of the lower part 2, prior to a widening 5 of the main shaft 1, is constructed as a male part of a detachable connection, such as, for example, an external threaded connection 6 having an external diameter which tapers toward a lower end of the ski stick or ski pole.

At an upper end of the main shaft 1, an internal portion of the main shaft 1 is hollowed; however, there is no overall reduction in an external diameter of the upper end of the main shaft 1. The upper portion of the main shaft 1 includes a thickened hollow section 7 with a female threaded sleeve 8 corresponding to the male threaded connection on the lower part 2. In a similar manner, a bore of the thickened hollow section 7 matches a lower smooth portion of the lower part 2, so that the lower part 2 of one stick can be inserted into a receptacle at the upper end of another ski stick or ski pole.

The ski stick or ski pole in the illustrated example includes a detachable disc 9 fitted to the ski stick or the ski pole in such a manner that the disc 9 protects the male threaded connection 6. Thus, the female thread of the hub 10 of the disc 9 corresponds to the male threaded connection 6 on the lower part 2. Thus, the disc 9 can be easily attached or detached. Another feature is that the disc 9 will protect the threaded connection 6 from damage and impact during use.

The ski stick or ski pole in the illustrated example is equipped with a hand grip 11 attached by a threaded plug 12 threaded into the threaded sleeve 8. Apart from allowing people to grasp the ski stick, the hand grip 11 also covers the opening into the main shaft 1 and protects the female threaded sleeve 8 from being contaminated with dirt. The hand grip 11 has a strap 13 attached by known means.

In the illustrated example, the ski stick or ski pole is provided with a tubular shaft 1 having an internal cavity, a receptacle, connected to the opening at the top end. This type of rod-shaped internal cavity can be manufactured from known materials such as, for example, aluminum.

The main shaft can be produced as a solid material for a part of a length thereof, and a cross-section can, for example, be polygonal, or hexagonal both in diameter or bore. The stick can also be manufactured of composite materials. The form of design which is illustrated is nevertheless a reasonable choice of materials and structure.

The disc 9 may have a threaded hole off center which enables two sticks to be joined together at an angle. There may also be a comparable threaded hole at one or both ends of the main shaft 1.

A number of modifications to the illustrated example are possible and we do not wish to be limited to the details described herein but intend to cover all such modifications as are encompassed by the scope of the appended claims.

We claim:

1. A ski pole, comprising a main shaft portion having an upper end portion with a first diameter and a lower end portion with a second diameter less than said first diameter, a first male threaded portion formed in a transition area between said upper portion and said lower end portion, a hollow portion formed within the upper portion of said main shaft portion, a female threaded portion formed within the upper end of said upper portion and having a thread corresponding to a thread of said first male threaded portion, a removable disc means threadable on said first male threaded portion, and a removable hand grip having a second male threaded portion adapted to be threadably received within said female threaded portion, said first and second male threaded portions and said female threaded portion having a conical cross-sectional configuration, and wherein said first male threaded portion, upon removal of said disc therefrom, is adapted to be threadably received within said female threaded portion of a corresponding ski pole upon removal of said hand grip from said corresponding ski pole.

2. A ski pole in accordance with claim 1, wherein said hollow portion adjacent said upper end is defined by a wall having a thickness greater than the thickness of the wall which defines the remainder of the hollow portion.

* * * * *